US006461655B2

(12) United States Patent
Bak

(10) Patent No.: US 6,461,655 B2
(45) Date of Patent: Oct. 8, 2002

(54) METHOD FOR PACKING SOYBEAN SPROUTS

(76) Inventor: Philip Y. Bak, 2821 La Plata Ave., Hacienda Heights, CA (US) 91745

( * ) Notice: Subject to any disclaimer, the term of this patent is extended or adjusted under 35 U.S.C. 154(b) by 41 days.

(21) Appl. No.: 09/833,563

(22) Filed: Apr. 13, 2001

(65) Prior Publication Data

US 2002/0025362 A1 Feb. 28, 2002

Related U.S. Application Data

(63) Continuation-in-part of application No. 09/365,031, filed on Aug. 2, 1999, now abandoned.

(51) Int. Cl.[7] ..... B65D 85/00

(52) U.S. Cl. ..... 426/106; 426/115; 426/410; 426/413; 426/629; 426/634

(58) Field of Search ..... 426/629, 634, 426/106, 115, 410, 413

(56) References Cited

U.S. PATENT DOCUMENTS 5,130,152 A 7/1992 Alameda
5,698,249 A 12/1997 Hayashi et al.

*Primary Examiner*—Milton I. Cano
*Assistant Examiner*—H. Mai
(74) *Attorney, Agent, or Firm*—Birch, Stewart, Kolasch & Birch, LLP

(57) ABSTRACT

A soybean sprout package comprising a bag having an open end portion, with multiple soybean sprouts clustered in the bag, the sprouts having elongated stems, the stems generally extending in the same direction at the open end portion, thereby enabling the user to readily grasp the stems as a bundle when the bag is opened.

4 Claims, 2 Drawing Sheets

METHOD FOR PACKING SOYBEAN SPROUTS

CROSS-REFERENCE TO RELATED APPLICATION

The present application is a continuation-in-part application of U.S. patent application Ser. No. 09/365,031, filed on Aug. 2, 1999 now abandoned.

BACKGROUND OF THE INVENTION

1. Field of the Invention

The present invention relates to a system for packaging edible bean sprouts having the roots removed therefrom and, more particularly, to a trapezoid-configured package of soybean sprouts having the heads thereof and elongated stems located in a cluster and positioned with the heads facing the lower interior of a bag, respectively, for storing the soybean sprouts in the bag and facilitating the cooking operation.

2. Description of the Related Art

In the past, soybean sprouts were indiscriminately packaged, so that stems extended in all directions in a package, with roots at the ends of the stems being displayed throughout the package. Also, the heads of the sprouts were exposed to light passing through transparent walls of the packages, causing the sprouts to quickly change color, from yellow to greenish. As a result, the packaged product became unsightly, requiring the heads to be cut from the bean sprouts. Also, the user had to slowly and painstakingly remove the roots from the ends of the sprout stems after removal from the package, and reorient the stems, prior to cooking. Thus, there is need for overcoming these problems and difficulties, so that soybean sprouts may be more appealingly displayed in packages, and made more quickly usable for cooking purposes.

SUMMARY OF THE INVENTION

It is an object of the present invention to provide a system for packaging edible soybean sprouts, which eliminates the above-mentioned problems encountered in conventional bean sprout packages.

Another object of the present invention is to provide an improved soybean sprout display package containing soybeans which are positioned in the bag so as to make the bag self-supporting. A quantity of soybean sprouts having elongated stems are clustered together with the heads facing the bottom of the bag and the severed ends of the bean sprouts facing the top of the bag. Since the heads of the soybean sprouts are wider than the cut stems, the heads clustered together and facing the bottom of the bag form a wide base, making each bag self-supporting and capable of standing independently. Also, since the cut stems do not face the bottom of the bag where moisture collects, there is eliminated the possibility of roots growing from the ends of the cut stems due to moisture.

A further object of the present invention is to provide a system for packing soybean sprouts which further includes an opaque bag wall panel at the bottom of the bag to protect them from direct exposure to light. The top of the bag can be provided with a transparent side wall portion which is located to permit viewing or observation of the stems.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
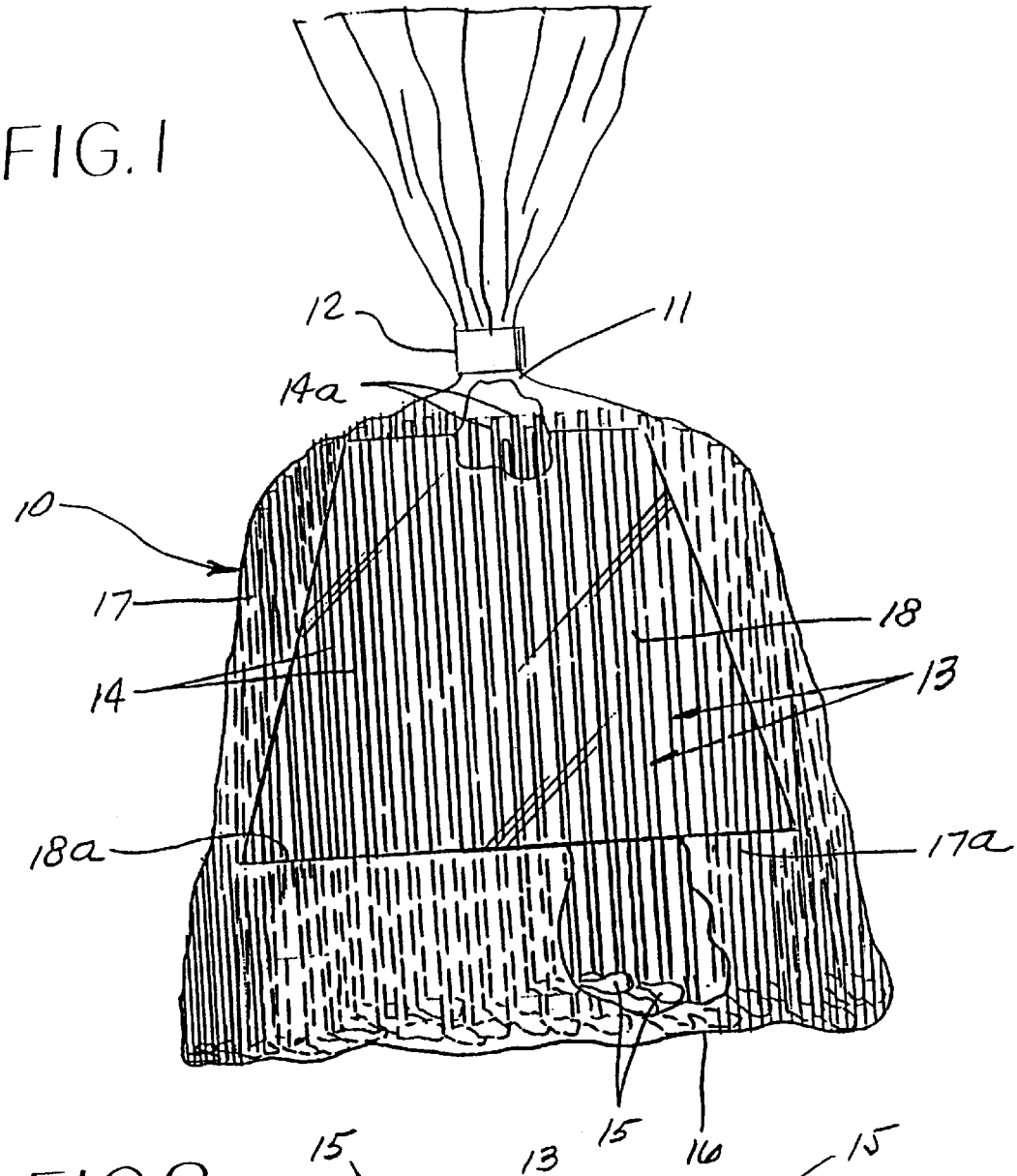
FIG. 1 is an elevational view showing the package of the present invention filled with soybean sprouts having stems which are located in the upper interior of a bag and are visible through a transparent portion of the bag, and soybean heads which are located in the lower interior of the bag.

Referring now in detail to the drawings for the purpose of illustrating preferred embodiments of the present invention, the system for packing soybean sprouts as shown in FIG. 1 includes a bag 10 having an open portion, at the top of the bag 11; a retainer or clip 12 for closing the top of the bag; and multiple soybean sprouts 13 clustered in the bag 10. The soybean sprouts have elongated stems 14 extending substantially in the upper direction of the bag so that they can be grasped as a bundle by the user when the bag is opened. The stems 14 terminate as severed ends 14*a*, with such ends positioned at or near the top of the bag 10, as shown in FIG. 1. The soybean sprouts are thus ready to be removed as in bunches from the bag 10 for cooking.

The soybean sprouts 13 have bead-like heads 15 which are disposed at the bottom wall 16 of the bag 10. The bag 10 containing the soybean sprouts 13 with stems 14 and heads 15 adopt a trapezoid-like configuration and an almost rectangular bottom surface 16 which facilitates storage on a shelf or in a refrigerator, or the like.

Because the stems 14 are located in the upper interior of the bag, the stem ends stay dry, eliminating the possibility of roots growing from the ends of the stems. Since the space occupied by the heads 15 is larger than the space occupied by the ends 14*a* of the stems 14, the bag 10 sits in a stable manner.

The bag 10 preferably consists of a flexible film plastic material, and has an opaque side portion 17, and a transparent side portion 18, or panel, located for viewing the stems 14, extending in substantially parallel relationship. The opaque bag side portion 17 preferably has a yellow coloring, which in general matches the yellow color of the heads 15 of the soybean sprouts 13, when fresh.

It will be noted that the side wall portion 17 includes a vertical band 17*a* immediately adjacent the lower edge 18*a* of the transparent sidewall portion. Edge 18*a* is just above the level of the heads 15, so that the heads 15 of the soybean sprouts 13 are substantially concealed from view, by the opaque band 17*a*. Therefore, any change in color, for example, darkening of the heads 15 is for the most part concealed, and such change in color due to light entering through the panel or portion 17 will be slowed due to the use of band 17*a*.

Reference will now be made to the steps involved in preparation of the package as shown in FIG. 1.

Figure 2:
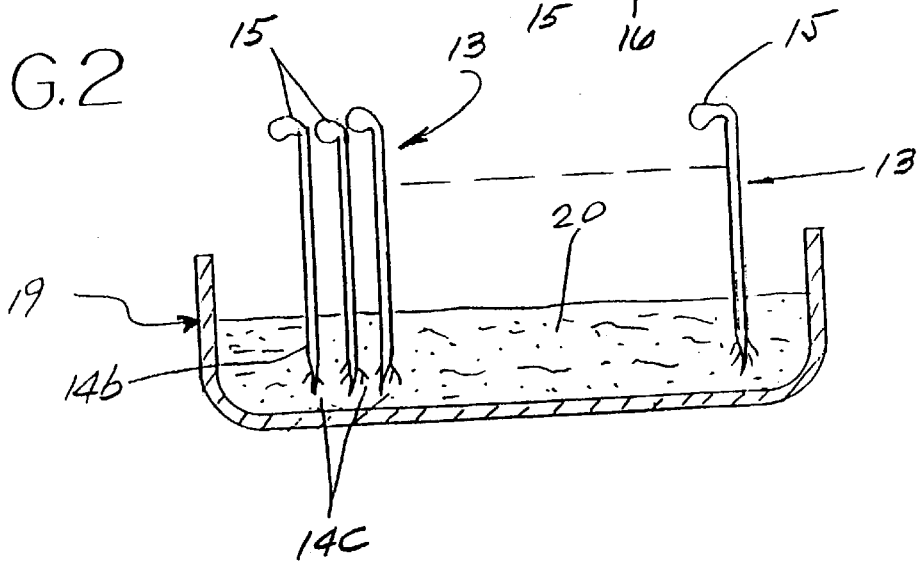
FIG. 2 is an elevational view that shows growth of soybean sprouts in a tub.
Figure 3:
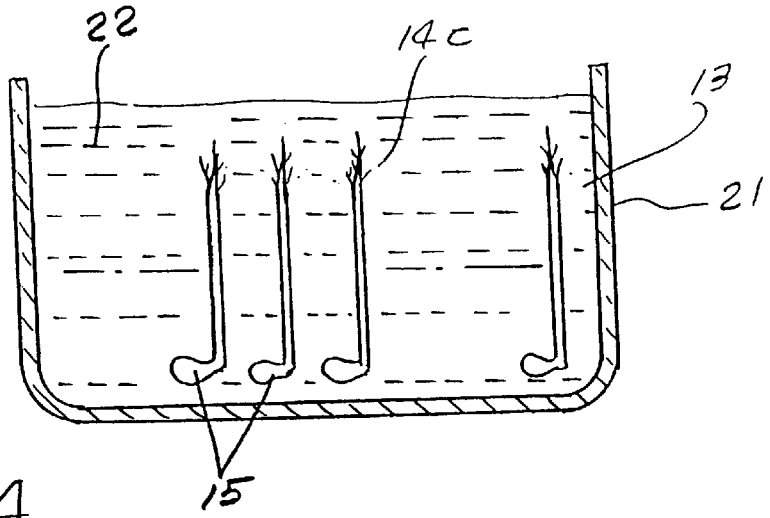
FIG. 3 is an elevational view that shows soybean sprouts removed from the tub of FIG. 2, and rinsed in a second tub.

Referring first to FIG. 2, it shows soybean sprouts 13 being grown in a vessel or tray 19, the soybean sprouts 13 having their heads 15 above the level of the nutrient substance 20 into which the root ends 14*b* of the stems extend. String-like roots 14*c* grow in the nutrient substance 20. In FIG. 3, the soybean sprouts 15 have been removed from the tray 19, inverted, and placed in a rinsing vessel 21 containing water 22 in which the soybean sprouts 13 are rinsed, by shaking in the water 22.

Figure 4:
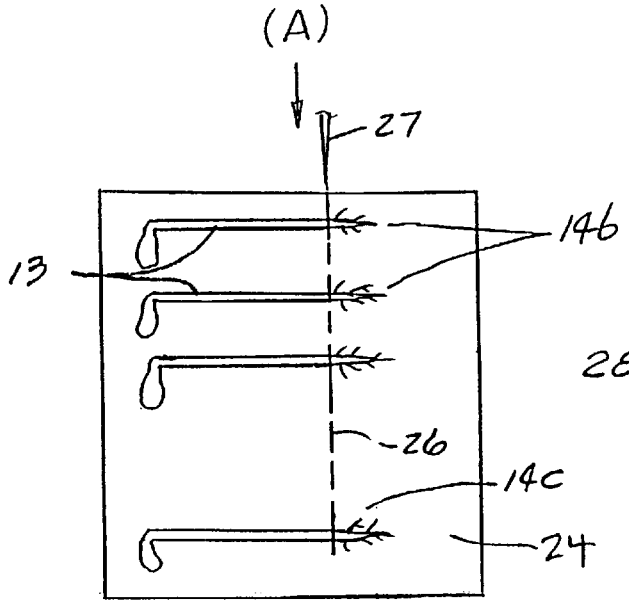
FIG. 4 is a plan view that illustrates cutting off the root ends of soybean sprouts laid on a cutting board.

As shown in FIG. 4, the rinsed soybean sprouts 14 are positioned on a cutting board 24 in the direction indicated by arrow (A), as shown, so that the stems 13 generally extend in parallel relationship. The ends 14*b* of the stems 14 from which the roots are growing are cut-off as along a line 26, using a cutter shown as element 27. This step produces the severed ends 14*a* of stems 14.

Figure 5:
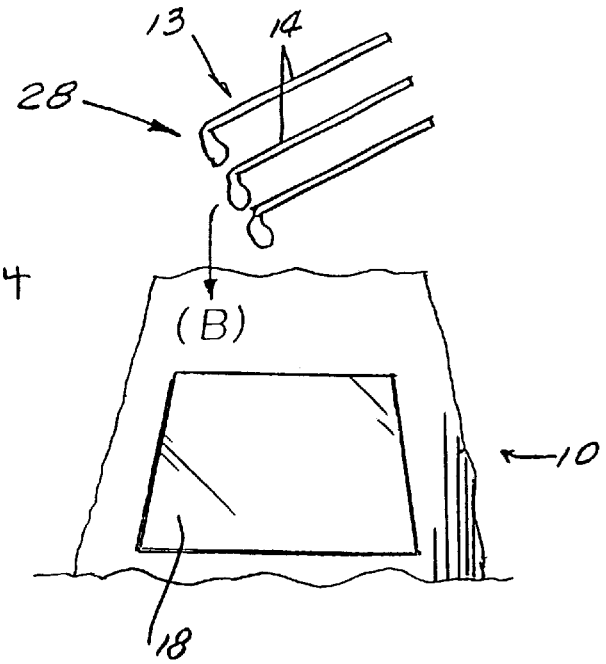
FIG. 5 shows adding the root cut soybean sprouts to a bag.

FIG. 5 shows the soybean sprouts 13 being placed at 28 into the opened bag 10 in the direction indicated by arrow (B). Therefore, the stems 14 of the soybean sprouts 13 will extend upright in registration with the transparent panel 18, when the bag is closed.

The basic steps of the method of providing a system for packaging soybean sprouts 13 includes a bag 10 having an open end portion and a closed end portion, multiple soybean sprouts 13 clustered together in the bag 10, with the sprouts 13 having elongated cut stems 14, facing in the upper direction where they can be grasped as a bundle by a user when the bag 10 is opened. When the bag containing the soybean sprouts is sealed or closed, the cut stems face the top of the bag and the heads of the soybeans face the bottom of the bag.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A method for packing soybean sprouts in a package, said method comprising:

providing a bag having an upper open end and a bottom closed end, said bag having a trapezoidal configuration and a substantially rectangular bottom for stably sitting in an unsupported position and for stably storing the heads of soybean sprouts so as to facilitate the cooking operation, said bag being constructed of a flexible plastic film material having an opaque side portion for concealing the soybean heads and a transparent side portion positioned near the open end for viewing the stems;

forming soybean sprouts into a cluster with all of the heads of the soybean sprouts facing in one direction and cut stems facing in the opposite direction;

placing the heads of the soybean sprouts into the closed end of the bag with the cut stems facing the open end of the bag; and closing the open end of the bag wherein said soybean sprout heads define a package base which is sufficiently broad to render the package of soybean sprouts self-supporting and free-standing.

2. The method for packaging soybean sprouts in claim 1, wherein the opaque side portion has a yellow coloring, said yellow coloring preventing viewing of the soybean heads.

3. The method for packaging soybean sprouts of claim 1, wherein a retainer is provided for closing the upper open end, the bag having a transparent side panel spaced below said upper open end.

4. The method for packing soybean sprouts of claim 3, wherein the soybean sprout heads are located in a cluster in the lower interior of the bag, said bag having an opaque side wall which conceals said heads from a sideward view.

* * * * *